US005938260A

United States Patent [19]

Wallace et al.

[11] Patent Number: 5,938,260

[45] Date of Patent: Aug. 17, 1999

[54] HAND CARRIER FOR SHRUNK WRAP COILS OF FILAMENTARY MATERIAL

[75] Inventors: Robert P. Wallace, Amawalk, N.Y.; Kenneth C. Newton, Danbury, Conn.

[73] Assignee: Windings, Inc., Patterson, N.Y.

[21] Appl. No.: 09/004,910

[22] Filed: Jan. 9, 1998

[51] Int. Cl.[6] ..... B65H 49/00

[52] U.S. Cl. ..... 294/168; 294/158; 242/596

[58] Field of Search ..... 294/34, 137, 158, 294/165, 167, 168; 242/129.5–129.62, 136, 170, 588, 588.2, 596, 596.4, 596.8

[56] References Cited

U.S. PATENT DOCUMENTS

| | | | |
|---|---|---|---|
| 1,620,918 | 3/1927 | Plotz | 242/129.53 |
| 1,848,744 | 3/1932 | Pavlas | 242/129.6 |
| 1,852,195 | 4/1932 | Shaw | 294/168 |
| 2,347,552 | 4/1944 | Gerrard | 242/588 |
| 3,645,429 | 2/1972 | Knapp | 294/168 |
| 3,705,698 | 12/1972 | Newman et al. . | |
| 4,842,216 | 6/1989 | Zajac . | |
| 5,551,647 | 9/1996 | Browning | 242/588.2 |
| 5,687,928 | 11/1997 | Lassiter | 242/588.2 |

*Primary Examiner*—Dean Kramer
*Attorney, Agent, or Firm*—Laubscher & Laubscher; R. J. Lasker

[57] ABSTRACT

A transportable carrier for removably retaining coils of filamentary material wound in a Figure-8 pattern and having a radial payout hole extending from the inner surface to the outer surface of the wound coil, wherein a pair of carriage assemblies each including a bottom frame member and an upper frame member interconnected by a pair of spaced apart vertically movable carriage assemblies, the pair of carriage assemblies being separated by a pair of spaced support members attached to a respective one of the bottom frame members and a handle extending between the respective upper frame members of the respective carriage assembly; each of the upper frame members including a retaining member for engaging the upper surface of a wound coil lying between the bottom frame members; and the handle enabling vertical upward and downward movement of the carriage assemblies to accommodate different sized wound coils; and vertical downward movement of the handle enabling each retaining member to engage an upper surface of a wound coil positioned in the carrier between the separated bottom frame members; and the pair of spaced apart support members supporting a bottom portion of the wound coil.

10 Claims, 3 Drawing Sheets

HAND CARRIER FOR SHRUNK WRAP COILS OF FILAMENTARY MATERIAL

BACKGROUND OF THE INVENTION

1. Field of the Invention

This invention relates to devices for hand-carrying wound coils of filamentary material and in particular to such devices in which various diameter wound coils of filamentary material, such as telephone wire or cable, may be retained in a hand-held carrier to enable such wire or cable to be drawn from the inside of the coil with the coil retained in the carrier by slidable spaced, opposed carriage assemblies, the height of which are simultaneously adjustable to accommodate different diameter wound coils; and a pair of filamentary material guide cones, one guide cone removably engaging one of the spaced, opposed carriage assemblies and inserted into the adjacent open end of the wound coil, and the other guide cone removably engaging the opposite carriage assembly and being inserted into the other adjacent open end of the wound coil.

2. Background Information

Wound coils of a filamentary material, such as wire or cable, are frequently retained in some sort of a hand-held carrier while the wire or cable is drawn from the wound coil and also enabling the wound coil to be transported from one area within a job site, or to a different job site.

Wound coils that are encased in shrunk wrap require a carrier to retain the wound coil as the shrunk wrap skin is very slippery and difficult to hold by hand. Thus, shrunk wrap wound coils must be retained by some mechanical retention means while the wire or cable is withdrawn from the inside of the coil at a job site.

Preferably, the hand-held carrier should be convenient to carry with a wound coil of wire or cable retained therein and afford a readily adjustable means for retaining variable diameter, shrunk wrap wound coils of wire or cable with a provision for mounting a wire guide cone in each end opening of the wound coil to stabilize the wound coil and enable the wire to be withdrawn from the inside of the wound coil, for example as is common with REELEX-type coils in which the filamentary material is wound in a figure 8 configuration with a radial hole extending from the outer wind to the inner wind, and the filamentary material is withdrawn from inside the wind, through the radial hole. REELEX is a trademark owned by the assignee of the present invention and registered under Registrations Nos. 1,000,554 and 1,259,164.

Furthermore, the hand-held carrier should be light in weight and made of durable material to withstand the rigorous use experienced at actual job sites where the wire or cable is being installed.

SUMMARY OF THE INVENTION

With respect to the following description, wherever filamentary material is mentioned it is understood that such reference applies not only to wound wire or cable coils, but to wound coils of any material that is capable of being wound in a Figure-8 coil configuration, and in particular to such Figure-8 coil configurations wherein the wound coil includes a radial payout hole extending from the outer surface of the coil to the inner surface thereof and whereby the filamentary material may be withdrawn from the inside of the wound coil through the radial payout hole.

A primary object of the invention is to provide a lightweight, hand-carryable carrier for retaining wound coils, each of variable diameter filamentary material, in which a guide cone is removably fastened to a movable carriage on each side of the wound coil to support the wound coil and enable the filamentary material to be withdrawn from the inside of the coil through a radial payout hole in the wound coil without twisting or "bird-nesting" and with the wound coil securely fastened within the hand-held carrier.

A primary feature of the invention is that a pair of spaced, movable carriage assemblies are simultaneously adjustable to accommodate different diameter wound coils which are clamped between spaced support members at the bottom of the carrier and a preformed clamp at the top of each of the movable carriage assemblies.

Thus, an advantage of the invention is that the carrier is easily and readily adaptable to retain different diameter wound coils to be unwound in situ at a workplace.

Another object of the invention is to provide a hand-held carrier of the type described herein that is molded from high density plastic material so that the components of the carrier are strong but relatively lightweight.

And a further feature of the invention is that the various component parts of the carrier are made from high density plastic such as polypropelene, thereby affording considerable strength and light weight to the various components of the carrier.

And a further advantage of the invention is that the carrier is relatively light, easy to operate and yet durable.

Another object of the invention is to provide a carrier of the type specified herein which includes means for easily mounting the wound coil in preconfigured positions to accommodate various diameter wound coils.

Another feature of the invention is that each movable carriage within each carriage assembly includes a mounting grid having a number of preconfigured apertures for removably mounting a guide cone from the outside of the carrier. Each guide cone includes projections which engage the selected preconfigured aperture to fasten the guide cone to the respective mounting grid. Each of the respective guide cones is positioned in a respective adjacent one end of the wound coil to enable filamentary material to be drawn from the wound coil as needed at the job site.

Therefore, other advantages of the invention are that: (1) each guide cone is alignable with the respective end opening of the wound coil simply by selecting a desired one of the plurality of preconfigured apertures in each of the respective mounting grids; (2) the guide cones are easily fastened to a respective mounting grid; and (3) the filamentary material may be paid out from the wound coil in a twistless manner as the guide cone in each end of the wound coil prevents the filamentary material from twisting as it is paid out from the wound coil.

Yet another object of the invention is to provide a simply operated means for retaining the wound coil in the carrier, which also serves to carry the carrier with or without a wound coil retained therein.

A further feature of the invention is that the carrying handle for the carrier extends between a respective top portion of each movable carriage assembly, thereby enabling the spaced, movable carriage assemblies to be simultaneously moved downwardly or upwardly by simply grasping the handle and, when the desired opening is obtained to accommodate the wound coil, pushing it to obtain the desired downward movement of the spaced, movable carriage assemblies so that the respective clamping members thereon engage the top of the wound coil and press it against respective stationary bottom support members extending between respective side frame members of the carrier.

A further advantage of the invention is that the carrying handle serves both as a handle for carrying the carrier and also as a means for raising and lowering the movable carriages to accommodate different diameter wound coils. Moreover, the wound coil is engaged with the respective preformed top clamping members and the respective bottom support members by a simple downward motion of the carrying-handle.

And yet another object of the invention is to provide a simple means for locking the movable carriages in a fixed position to retain a coil in the carrier.

And yet another feature of the invention is that the movable carriage assemblies are each locked into a desired position by a pair of threaded locking nuts accessible on the outside of each opposing side wall frame supporting the respective movable carriage assemblies.

And yet another advantage of the invention is that the locking of the movable carriage assemblies in a desired position is achieved by simply rotating four locking nuts on the outside of the carrier.

BRIEF DESCRIPTION OF THE DRAWINGS

The above objects, features and advantages are believed to be readily apparent from the following description of the best mode of carrying out the invention when taken in conjunction with the following drawings, wherein.

DETAILED DESCRIPTION OF THE PREFERRED EMBODIMENT OF THE INVENTION

Figure 1:
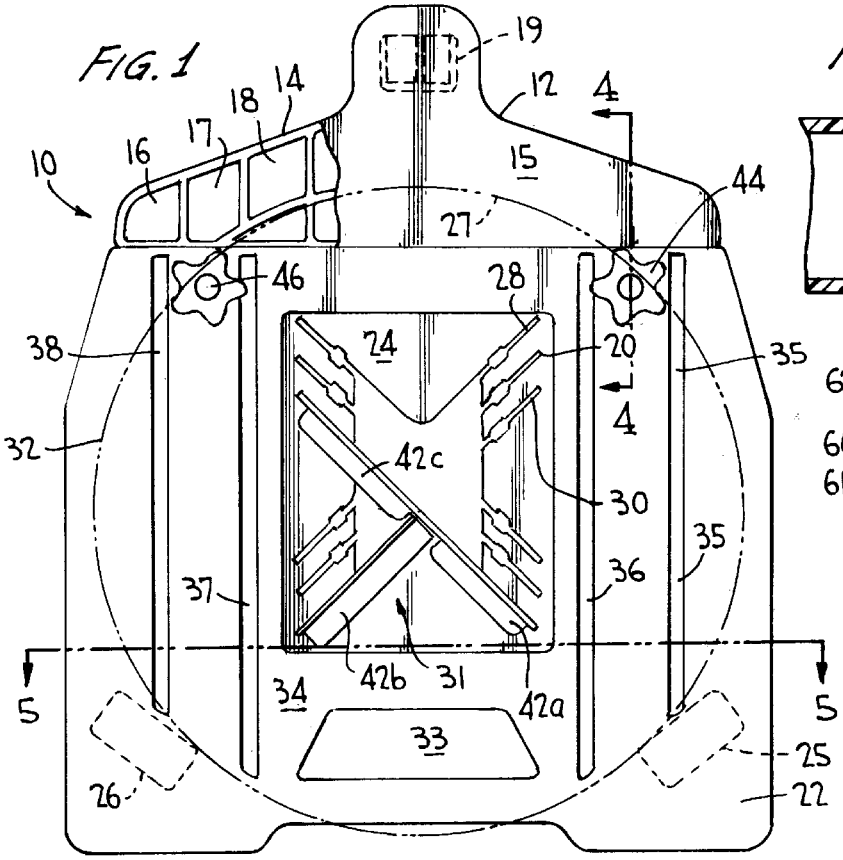
FIG. 1 is a partially cut-away side elevation view of the carrier in accordance with the invention.
Figure 2:
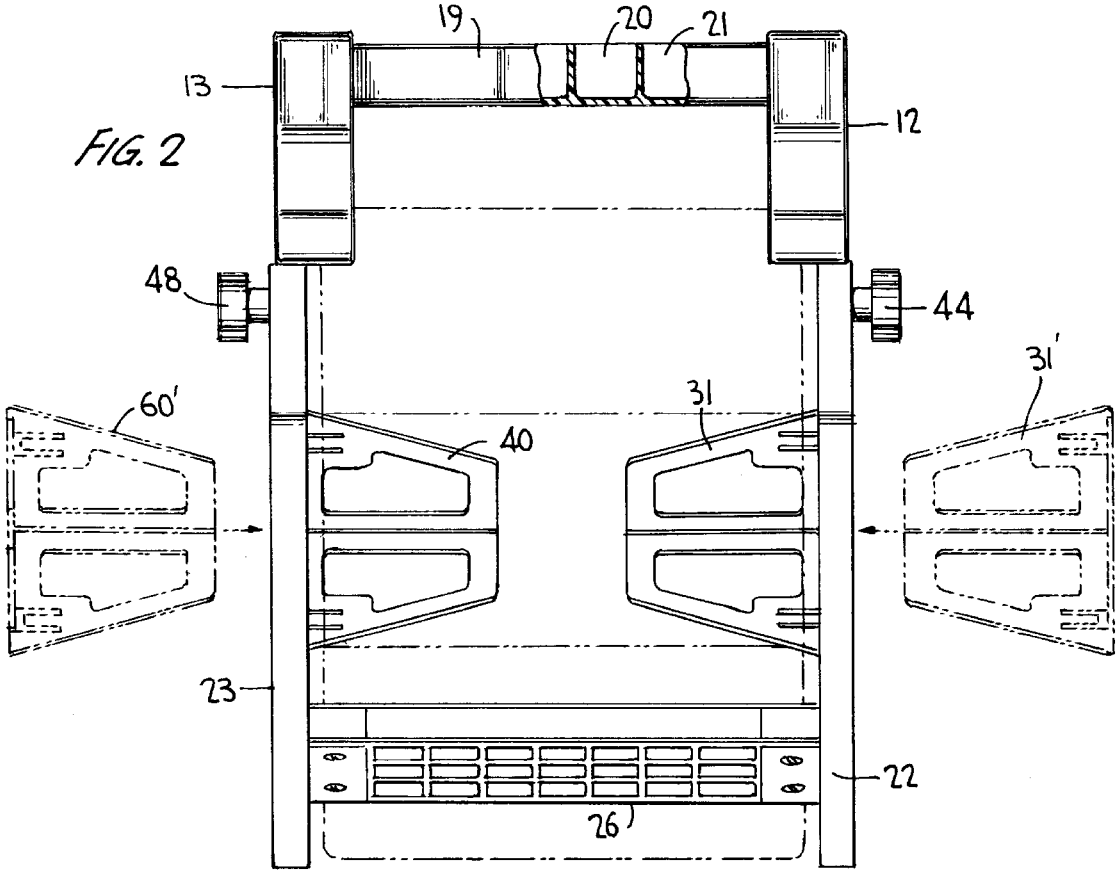
FIG. 2 is a front elevation view of the carrier according to FIG. 1, showing the mounting of the guide cones in the carrier and with the guide cones shown in phantom outside the carrier prior to being inserted through a respective preconfigured aperture and locked in position on the mounting grid shown in FIG. 1.

With reference to FIGS. 1 and 2, carrier 10 includes a pair of spaced upper frame members 12, 13, each having a skeletal rib frame 14 covered by a molded integral plastic skin 15. Hollow portions 16, 17 and 18 exist throughout the upper frame member 12 to lessen the weight of the frame member. Handle 19 (in phantom in FIG. 1) extends between upper frame members 12, 13 as shown in FIG. 2. Handle 19 is also constructed with hollow sections 20, 21 as shown in the cutaway portion of FIG. 2. Spaced lower frame members 22, 23 support each upper frame member 12, 13 and an associated movable carriage assembly 24 in a manner to be described more fully hereinafter. Lower support members 25, 26 are illustrated in phantom lines in FIG. 1 and support the bottom of the wound coil retained in the carrier 10 between each curved bottom portion 27 of upper frame member 12 (upper frame member 13 also includes a similarly shaped portion). Mounting grid 31*a* includes a plurality of preconfigured apertures 28, 29, 30, each adapted to receive and mount a guide cone 31 which is positioned within the end opening of a wound coil retained (dashed circle 32) within curved bottom portion 27 of upper frame member 12 and lower support members 26, 27. Cutout portion 33 in the lower portion 34 of the lower frame member 22 is provided within the mold for forming the movable carriage 24 to reduce the weight of the carrier 10. Molded guide rails 35, 36 and 37, 38 engage with respective carriage guide members (not shown) to enable movement of upper frame member 12, which will be described more fully hereinafter.

The guide cones 31, 40 are described in U.S. Pat. No. 4,842,216, entitled "Folding Cone Package Design" and assigned to the same assignee as the subject application. As set forth at column 2, lines 22–35 of that patent:

"The present invention utilizes foldable cones molded from polypropylene or plastic material into an essentially two-part foldable planar form with upstanding projections representative of desired features of the cone and, including designated fold strips enabling the two parts of the cone to be folded along the fold strips and assembled into an operable cone element. The essentially planar structure of the unassembled cone elements affords a means of storing such elements in a minimum amount of space. Each of the two-part elements includes respective guide and retention members engagable with one another to maintain an assembled cone in an assembled state."

The disclosure of U.S. Pat. No. 4,842,216 is incorporated herein for the purpose of defining the structure of the guide cones used in the present invention.

With continuing reference to FIG. 2, guide cones 31, 40 are illustrated in their respective mounted positions within a selected one of the plurality of preconfigured apertures 28, 29, 30 in a mounting grid 31*a* such as that illustrated with respect to FIG. 1 as described above. The guide cones 31, 40 are inserted into their respective preconfigured aperture (such as preconfigured apertures 28, 29, 30) from the outside of lower side frame members 22, 23 as indicated by guide cones 31', 40' shown in phantom in FIG. 2. The particular preconfigured aperture is selected so that the guide cone will fit into the end opening in the wound coil being retained in the carrier (to be fully described hereinafter).

The guide cone 40 is retained in mounting grid 31*a* (FIG. 1) by a combination of projecting strips 42*a*, 42*b*, 42*c* and retainers 42*d* and 42*e* (FIG. 2) as described in the aforesaid U.S. Patent. Essentially projection strips 42*a*, 42*b* and 42*c* prevent the guide cone 40 from passing through the particular preconfigured aperture in which the guide cone has been inserted, and retainers 42*d* and 42*e* are biased to engage a solid portion of the mounting grid 31*a* at areas 43*a*, 43*b*, respectively, as illustrated in FIG. 2 to prevent the guide cone 40 from being retracted from the preconfigured aperture. Guide cone 40 is removed from the preconfigured aperture in mounting grid 31*a* by depressing each of biased retainers 42*d* and 42*e*, thereby enabling the guide cone to pass through the preconfigured aperture.

With reference to FIGS. 1 and 2, locking knobs 44, 46, 48 are hand-rotatable to tighten or loosen the respective movable carriage mounted within lower side frame members 22, 23 as will be more fully described hereinafter.

In the side elevation view of FIG. 3, upper frame member 12 of carrier 10 includes a movable carriage assembly comprising molded carriage strips 50, 52, each including guide apertures 51, 53 slidably engaging a respective guide assembly (not shown) attached to lower frame member 22 by locking knobs 44, 46, as will be more fully described hereinafter with respect to FIG. 4. With locking knobs 44, 46 loosened, upper frame member 12 and carriage strips 50, 52 are lowered and raised simply by lowering and raising handle 19.

Circle 54*a* represents the diameter of a wound coil positioned within carrier 10 and resting on bottom support members 25, 26. Circle 56*a* represents the diameter of another wound coil positioned within carrier 10 and also resting on bottom support members 25, 26. It is to be understood that only one wound coil at a time can be accommodated within carrier 10. Wound coil 54*a* is securely clamped within carrier 10 merely by lowering handle 19 until curved bottom portion 27 of upper frame member 12 abuts against the upper portion of the wound coil represented by circle 54*a*. A wound coil of greater diameter is also secured within carrier 10 by first raising handle 19 to provide clearance for the wound coil and then by moving handle 19 downwardly until curved bottom portion 27 of upper frame member 12 abuts against the upper surface of a wound coil represented by circle 56*a*. A wound coil is placed into carrier 10 by resting the bottom surface of the wound coil, represented by circle 54*b* on bottom support member 25 and rolling the wound coil into the position represented by circle 54*a*. Similarly, a wound coil of greater diameter, such as that represented by circle 56*b*, is placed in carrier 10 by resting the bottom surface of the wound coil on bottom support member 25 and rolling the wound coil into the position represented by circle 56*a*. It is apparent that in such loading operations handle 19 must be raised to a height that will enable the wound coil to be placed in the carrier as described above.

With a wound coil placed within the carrier 10 as described above, locking knobs 44, 46 (along with a similar pair of locking knobs for the oppositely disposed carriage assembly) are tightened and the wound coil is securely clamped within the carrier 10 between curved upper surface 27 of upper frame 12 and lower support member 25. A similar clamping is effected with the oppositely disposed upper frame member 13 and lower support member 26 (Ref. FIGS. 1 and 2).

Figure 4:
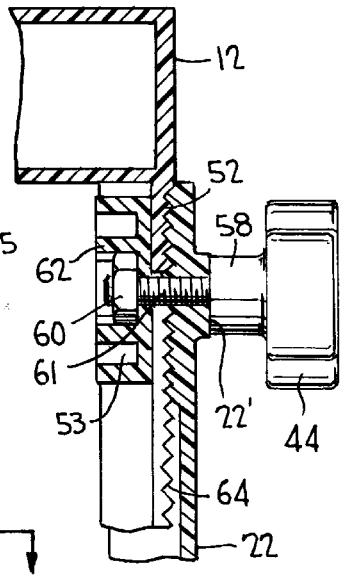
FIG. 4 is a section along lines 4—4 of FIG. 1 showing the structure of the mechanism for guiding movement of the movable carriage assemblies and for locking them in place.
Figure 3:
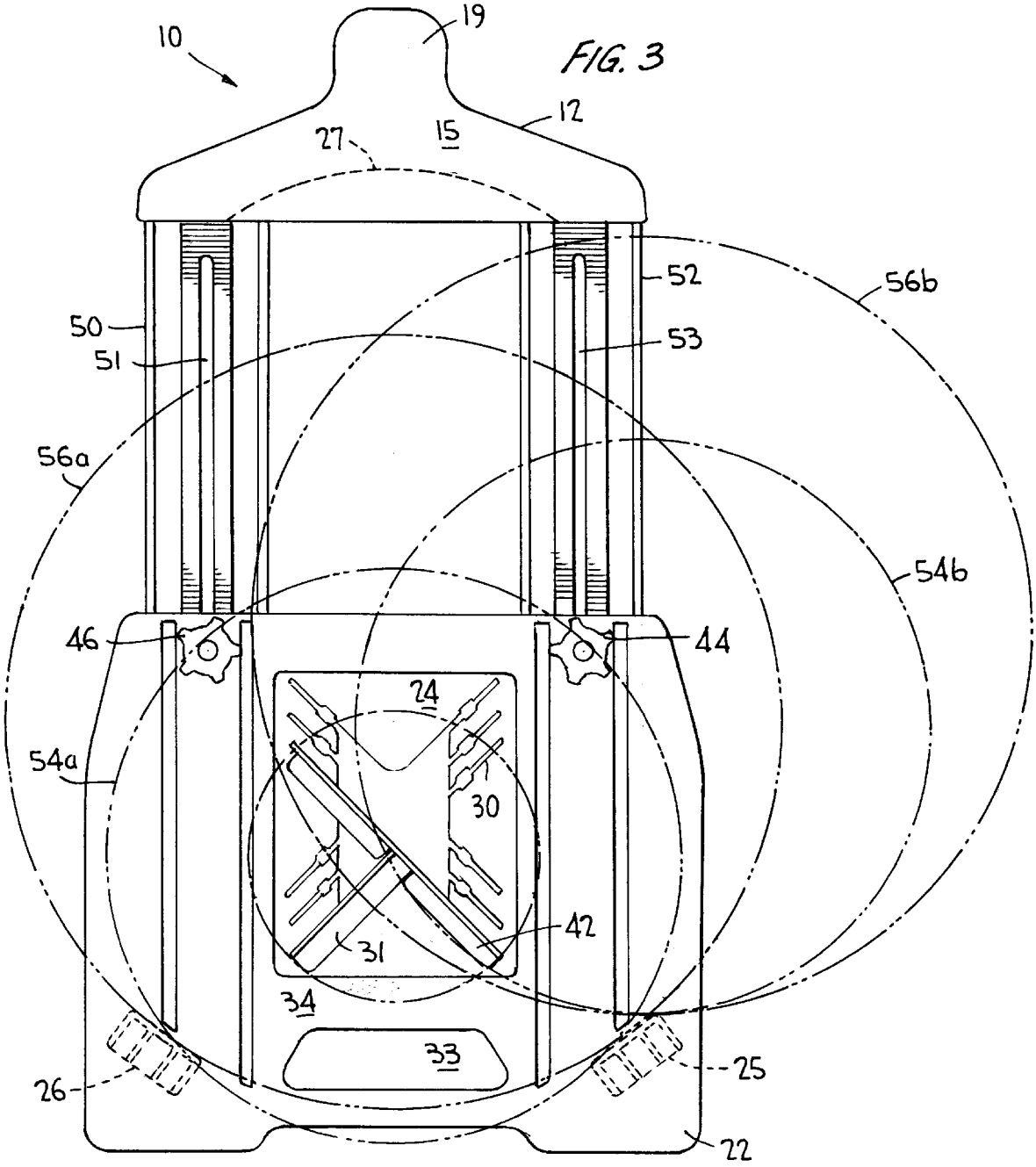
FIG. 3 illustrates a partial cut-away, side elevation view of one of the two movable carriage assemblies shown in a fully upwardly extended position and wherein the dashed circles represent different diameter wound coils and the manner in which they are rolled into the carrier.

FIG. 4 illustrates an exemplary embodiment of the guide assembly and locking mechanism for one of the carriage strips 52 (FIG. 3). Locking knob 44 includes threaded portion 61 and a neck portion 58 adjacent projection 22' of lower frame member 22. A locking nut 60 is threaded on threaded portion 61 of locking knob 44 and the locking nut 60 is retained within locking assembly 62 so that carriage 52 is free to slide with respect to the locking assembly 62. Thus, with locking knob 44 rotated to release the abutting relationship between neck 58 and projection 22' of upper frame member 22 and thereby enabling carriage 52 with a ridged back 64 to release engagement with an oppositely disposed portion of upper frame member 22, so that the carriage 52 is free to slide with respect to locking assembly 62, thereby enabling the carriage 52 to be lowered or raised in accordance with the lowering or raising of handle 19. It is of course understood that the locking knob 46 associated with the related carriage 50 and the locking knobs associated with the oppositely disposed movable carriage must also be loosened to disengage the respective locking assemblies from their respective engagement with the upper portion of the respective frame member, thereby freeing the respective carriage strips in a like manner as that described above to enable the carrier handle 19 to be raised or lowered.

Figure 5:
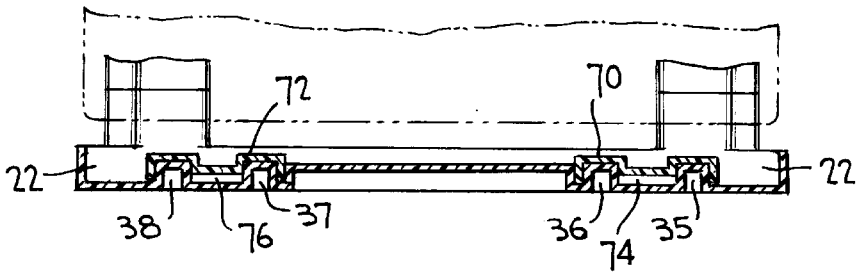
FIG. 5 is a section along lines 5—5 of FIG. 1 and illustrating the guide rails for enabling movement of the movable carriage assemblies.

FIG. 5 illustrates the structure of the carriage assemblies 70, 72 which respectively move over guide rails 35, 36 and 37, 38 within lower frame member 22. Rails 35, 36, 37 and 38 are integrally molded into lower frame member 22. Apertures 74, 76 are respectively formed within carriage assemblies 70 and 72 to enable each of the carriage assemblies to pass by the associated guide assembly attached to the respective locking knob as described above with respect to FIG. 4.

Figure 6:
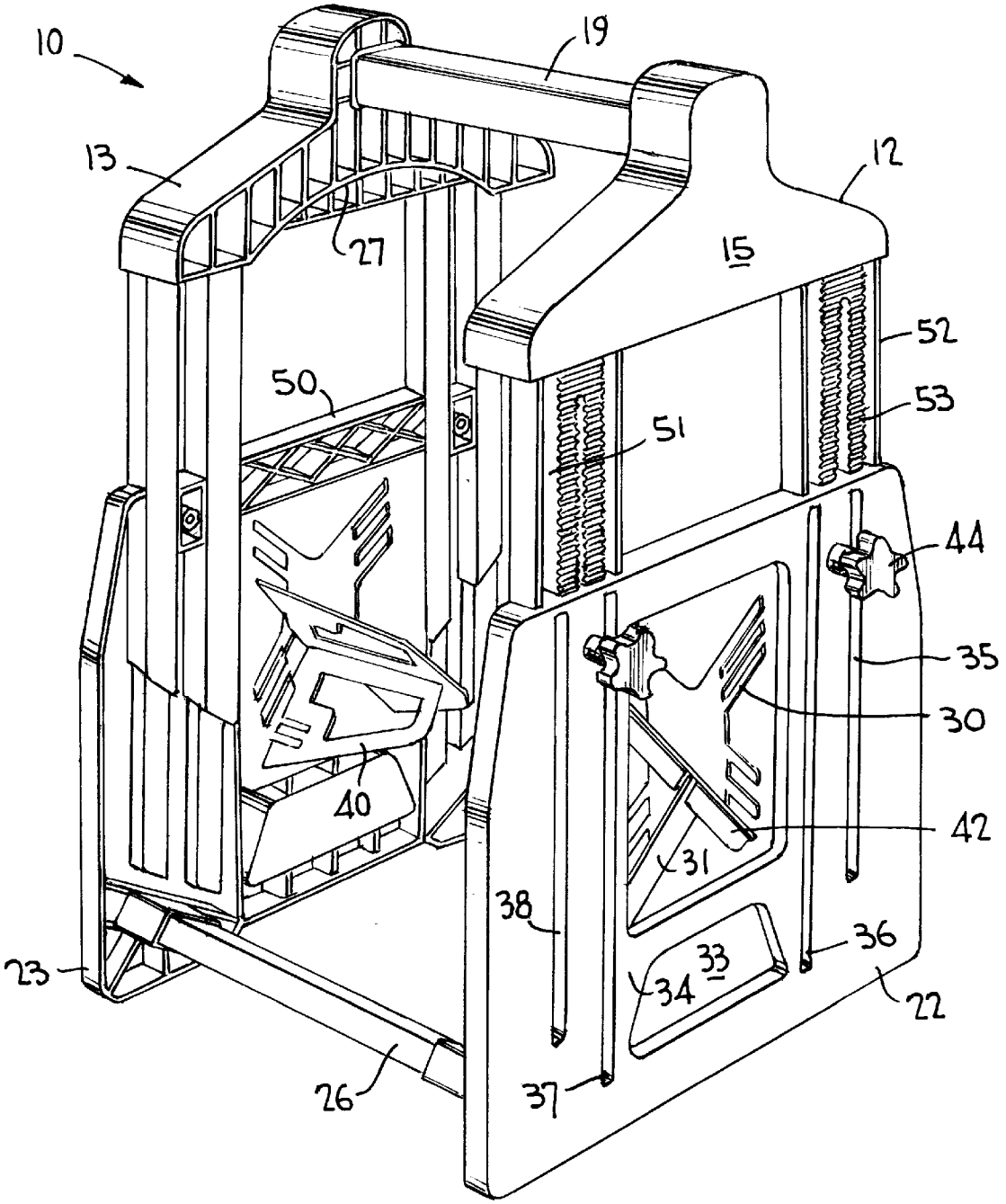
FIG. 6 is a perspective view of the carrier showing the basic operating components of the invention and including a pair of cones mounted in the oppositely disposed carriage assemblies for retaining a wound coil therein.

A perspective view of the carrier of the invention is shown in FIG. 6, wherein lower frame members 22 and 23 are interconnected in spaced relation to one another by a pair of lower support members (only one support member 26 being shown in FIG. 6). Lower frame member 22 includes spaced guide rails 35, 36 and 37, 38 for respectively supporting movable carriage strip 50 and guide apertures 51 and movable carriage strip 52 and guide apertures 53. Lower frame member 23 includes identical guide rails, guide apertures and carriage strips as that described herein for lower frame member 22. Upper frame members 12, 13 are respectively attached to the respective carrier strips and guide apertures, and upper frame members 12 and 13 are joined by handle 19 as shown in FIG. 6. As described herein with respect to FIG. 4, the loosening of locking knobs 44, 46 and similar locking knobs on lower frame member 23 (see the description of FIG. 4), the upper frame members 12, 13 are allowed to be raised or lowered by the raising or lowering of handle 19, thereby enabling a wound coil to be placed in the carrier 10 with the lower portion thereof resting on the lower support members (only lower support member 26 being illustrated in FIG. 6; see the description of FIG. 3 for a detailed description of the manner in which a wound coil is placed in the carrier and locked in position therein). With locking knobs 44, 46 of lower frame member 22 and the counterpart locking knobs of (not shown) lower frame member 23 loosened, handle 19 is raised as necessary to allow the top of the wound coil to be placed within the carrier between frame members 22 and 23, and then the handle 19 is lowered until the respective upper curved surfaces (only upper curved surface 27 being illustrated in FIG. 6) contact the upper portion of the wound coil, whereupon locking knobs 42, 44 and their respective counterparts on lower frame member 23 are tightened to prevent movement of the upper frame members 12, 13.

With a wound coil locked in place within carrier 10, guide cone 31 is inserted through a selected one of preconfigured apertures 30 in movable carrier assembly 24, and then opened and inserted into one open end of the wound coil. In a similar manner guide cone 40 is inserted into an associated one of the preconfigured aperture in the movable carriage assembly on the opposite side of the carrier 10 (see the description of FIG. 2). It is evident that the proper apertures in which to insert the respective guide cones is easily determined as being those apertures that will enable the cone to be opened within the respective end of the wound coil. As is further evident from a consideration of the description set forth in the aforementioned U.S. Pat. No. 4,482,216, the guide cones prevent "bird-nesting" and tangling of the wound filamentary material as it is unwound through the radial payout hole of the wound coil.

The above description serves only to describe an exemplary embodiment of making the hand-held carrier to demonstrate its construction and operation. Thus, the invention is not intended to be limited thereby, but by the scope accorded the claims appended hereto, as those skilled in the use of wound coils of filamentary material will readily perceive modifications of the above-described embodiment that are within the scope of embodiments described herein.

What is claimed is:

1. A transportable carrier for removably retaining coils of filamentary material wound in a Figure-8 pattern and having a radial payout hole extending from the inner surface to the outer surface of the wound coil, comprising:

a pair of carriage assemblies each including a bottom frame member and an upper frame member interconnected by a pair of spaced apart vertically movable carriage assemblies, said pair of carriage assemblies being separated by a pair of spaced support members attached to a respective one of said bottom frame members and a handle extending between the respective upper frame members of the respective carriage assembly;

each of said upper frame members including a retaining member for engaging the upper surface of a wound coil lying between said bottom frame members; and said handle enabling vertical upward and downward movement of said carriage assemblies to accommodate different sized wound coils, and vertical downward movement of said handle enabling each retaining member to engage an upper surface of a wound coil positioned in said carrier between the separated bottom frame members, and said pair of spaced apart support members supporting a bottom portion of the wound coil.

2. A transportable carrier according to claim 1, further comprising means for locking each said pair of carriage assemblies in a desired position wherein said wound coil is retained in said carrier.

3. A transportable carrier according to claim 2, wherein each said movable carriage assembly includes a pair of spaced carriage strips, each including guide apertures; and each said lower frame member including a guide assembly; each said guide apertures slidably engaging a respective one of said guide assemblies, thereby enabling each of said vertically movable carriage assemblies to move.

4. A transportable carrier according to claim 3, wherein said means for locking includes a locking assembly positioned on one side of a respective one of said guide apertures and a rotable locking knob threadably engaged with said locking assembly, whereby the rotation of each of said locking knobs causes said movable carriage to be clamped between the locking knob and said locking assembly, thereby preventing movement of said vertically movable carriages.

5. A transportable carrier according to claim 4, wherein each said means for locking further includes a ridged backing member for engaging a respective one of each said lower bottom frame with the respective locking assembly locked.

6. A transportable carrier according to claim 5, wherein each said rotatable knob includes a threaded member extending through said guide aperture and into said locking assembly, and said locking assembly further including a captive nut engaging said threaded member, whereby rotation of each said locking knob causes said captive nut to loosen or tighten depending on the direction of rotation of said locking knob, and thereby causing said ridged back to be unclamped or clamped between said upper frame and said locking assembly.

7. A transportable carrier according to claim 2, wherein said means for locking includes a locking assembly positioned on one side of a respective one of said movable carriage assemblies and a rotable locking knob threadably engaged with said locking assembly, whereby the rotation of each of said locking knobs causes said movable carriage to be clamped between the locking knob and said locking assembly, thereby preventing movement of said vertically movable carriages; and wherein each said movable carriage assembly further includes a mounting grid for receiving and retaining a guide cone for positioning within a respective end opening of the wound coil.

8. A transportable carrier according to claim 1, wherein each said movable carriage assembly further includes a mounting grid for receiving and retaining a guide cone for positioning within a respective end opening of the wound coil.

9. A transportable carrier according to claim 8, wherein each said mounting grid includes a plurality of spaced apart preconfigured apertures each adapted to receive and mount said guide cone in a different position within said mounting grid, thereby enabling the guide cone to be positioned within the end opening of different sized wound coils retained in the carrier.

10. A transportable carrier according to claim 9, wherein said guide cone includes projecting strips for engaging an outer wall surface of said mounting grid and preventing the guide cone from passing completely through the preconfigured aperture and retainers biased to engage the inner wall surface of said mounting grid to prevent said guide cone from being retracted from said mounting grid.

* * * * *